US008343704B2

(12) United States Patent
Ikama et al.

(10) Patent No.: US 8,343,704 B2
(45) Date of Patent: Jan. 1, 2013

(54) METHOD OF PRODUCING TONER, AND TONER

(75) Inventors: Jun Ikama, Ichinomiya (JP); Masateru Kawamura, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 301 days.

(21) Appl. No.: 11/453,821

(22) Filed: Jun. 16, 2006

(65) Prior Publication Data

US 2006/0286480 A1 Dec. 21, 2006

(30) Foreign Application Priority Data

Jun. 17, 2005 (JP) ..... 2005-177994

(51) Int. Cl.
*G03G 9/08* (2006.01)

(52) U.S. Cl. ..... 430/137.15; 430/137.1; 430/137.16; 430/137.17

(58) Field of Classification Search ..... 430/137.1, 430/137.16, 137.17, 137.15
See application file for complete search history.

(56) References Cited

U.S. PATENT DOCUMENTS

| | | | | |
|---|---|---|---|---|
| 5,885,743 | A | 3/1999 | Takayanagi et al. | |
| 6,203,957 | B1 * | 3/2001 | Nomura et al. | 430/110.4 |
| 6,248,491 | B1 | 6/2001 | Takayanagi et al. | |
| 2002/0051923 | A1 * | 5/2002 | Takayanagi et al. | 430/108.4 |
| 2003/0032749 | A1 * | 2/2003 | Endo | 526/279 |
| 2003/0077536 | A1 * | 4/2003 | Yamashita et al. | 430/110.3 |
| 2004/0219448 | A1 * | 11/2004 | Kato et al. | 430/108.6 |

FOREIGN PATENT DOCUMENTS

| | | | |
|---|---|---|---|
| JP | 61-258260 | A | 11/1986 |
| JP | 6-332225 | | 12/1994 |
| JP | 9-230626 | | 9/1997 |
| JP | 10-010779 | A | 1/1998 |
| JP | 10-186714 | A | 7/1998 |
| JP | 10-319639 | | 12/1998 |
| JP | H11-084732 | | 3/1999 |
| JP | 2001-092176 | | 4/2001 |
| JP | 2001-100454 | A | 4/2001 |
| JP | 2002-131977 | | 5/2002 |
| JP | 2004-287149 | A | 10/2004 |
| JP | 2004-354411 | | 12/2004 |

OTHER PUBLICATIONS

Notice of Decision of Refusal for Japanese Patent Application No. 2006-166421, dated Oct. 18, 2011.
Notice of Reasons for Rejection issued for corresponding Japanese Patent Application No. 2006-166421 mailed on Mar. 15, 2011.

* cited by examiner

*Primary Examiner* — Mark F Huff
*Assistant Examiner* — Rachel Zhang
(74) *Attorney, Agent, or Firm* — Banner & Witcoff, Ltd.

(57) ABSTRACT

Spherical-shaped liquid droplets are made by dispersing oil phase containing: a resin with an acid group, a first hydrophobic solvent effecting dissolution of the resin, a colorant, and a charge control agent which is positively charged in an aqueous dispersion medium in the presence of a base; and the liquid particles are solidified to be solid particles by removing the first solvent from the liquid droplets. The solid particles obtained in this manner are washed with a second solvent. As the second solvent, a solvent which dissolves the charge control agent and but does not dissolve the resin such as alcohol is selected. Accordingly, the charge control agent in the solid particles are made to elute to the outer surface layer of the solid particles, thereby improving the positive chargeability of the solid particles.

17 Claims, 3 Drawing Sheets

METHOD OF PRODUCING TONER, AND TONER

CROSS REFERENCE TO RELATED APPLICATION

The present application claims priority from Japanese Patent Application No.2005-177994, filed on Jun. 17, 2005, the disclosure of which is incorporated herein by reference in its entirety.

BACKGROUND OF THE INVENTION

1. Field of the Invention

The present invention relates to a method of producing spherical-shaped toner by dispersing oil phase containing a resin with an acid group in an aqueous dispersion medium in the presence of base, in particular relates to a method of producing positively-charged toner particles with high chargeability.

2. Description of the Related Art

As conventional methods for producing toner, the pulverizing method, suspension polymerization method, dissolve suspension method and the like are known. The pulverizing method, however, has a disadvantage that it is difficult to obtain spherical-shaped particles with the method. In the suspension polymerization method, on the other hand, since toner is obtained by polymerizing monomer, a low-molecular weight component with low polymerization degree is generated together with predetermined or desired toner particles. Accordingly, there are problems such that the yield is low by the amount of the generated low-molecular weight component, and that additional cost is needed for recovery and disposal of low-molecular weight component. Further, in the dissolve suspension method, an emulsifying agent is used for stabilizing the liquid-droplet state in which the resin is held, washing needs to be repeated many times to remove the emulsifying agent from the toner particles. Accordingly, when the emulsifying agent cannot be successfully removed by the washing and remains in the toner particles, such remaining emulsifying agent adversely affects the physical property of the toner particles in some cases.

On the other hand, Japanese Patent Application Laid-open No. 10-319639 describes a method of obtaining spherical-shaped toner particles by dispersing a hydrophobic liquid composition containing a resin with an acid group, a hydrophobic solvent capable of dissolving the resin, and a colorant, in an aqueous dispersion medium in the presence of base so as to make the hydrophobic liquid composition into liquid droplets; and by removing the solvent from the liquid droplets to solidify the liquid droplets. In this method, the acid group possessed by the resin is neutralized by the base to be ionized in the aqueous dispersion medium. Accordingly, the hydrophilic property of the ionized portion of the hydrophobic liquid composition becomes high. As a result, the hydrophobic liquid composition become liquid droplets of which outer surface is hydrophilic and of which inner portion is hydrophobic and the liquid droplets disperse by themselves (self-disperse) in the aqueous dispersion medium. Accordingly, it is possible to obtain liquid droplets having stable spherical shape without using any emulsifying agent, and after removing the solvent from the liquid droplets by means of heating or the like, spherical-shaped toner particles can be obtained.

Thus, the method described in Japanese Patent Application Laid-open No. 10-319639 has advantages that it is possible to obtain the spherical-shaped particles, which are difficult to produce by the pulverizing method, that no low-molecular weight component is generated as in the suspension polymerization method, and that there is no need to use any emulsifying agent as in the dissolve suspension method.

The method described in Japanese Patent Application Laid-open No. 10-319639, however, still needs to be improved, specifically because of the disadvantage that it is difficult to obtain positively charged toner with this method. To provide more detailed explanation, in general, toners can be roughly classified into positively charged toner and negatively charged toner. The positively charged toner can be obtained by adding a charge control agent which is positively charged, during the production of toner.

In case of the method of Japanese Patent Application Laid-open No. 10-319639, however, there is a disadvantage that the charge amount cannot be sufficiently increased merely by adding a charge control agent which is positively charged, which results in adversely affecting the image quality of an image finally obtained by using the toner such that a phenomenon so-called "fog" is easily occurred.

In addition, an additive such as silica is sometimes added to this kind of toner so as to increase the fluidity of the toner. However, when the additive such as silica is added, the problem that the charge amount cannot be sufficiently increased as described above becomes more prominent.

SUMMARY OF THE INVENTION

The present invention has been made so as to solve the above-described problems, an object of which is to make it possible to produce positively-charged toner particles with high chargeability, in a method of producing spherical-shaped toner by dissolving oil phase which contains a resin with an acid group in an aqueous dispersion medium in the presence of base.

According to a first aspect of the present invention, there is provided a method of producing a toner, the method including the steps of:

forming an emulsion having: liquid droplets containing a resin with an acid group, a first solvent which is hydrophobic and in which the resin is dissoluble, a colorant, and a charge control agent which is positively charged; and an aqueous dispersion medium which disperses the liquid droplets;

forming solid particles by removing the first solvent from the liquid droplets in the emulsion to solidify the liquid droplets; and washing the solid particles with a second solvent in which the charge control agent is dissoluble and the resin is insoluble.

According to a second aspect of the present invention, there is provided a method of producing a toner, the method including the steps of:

forming an emulsion having: liquid droplets containing a resin having a terminal group which is a carboxyl group, a first solvent which is hydrophobic and in which the resin is dissoluble, a colorant, and a charge control agent which is positively charged; and an aqueous dispersion medium which disperses the liquid droplets;

forming solid particles by removing the first solvent from the liquid droplets in the emulsion to solidify the liquid droplets; and washing the solid particles with a second solvent in which the charge control agent is dissoluble and the resin is insoluble.

In the method of producing the toner of the present invention, the step of forming the emulsion may include neutralizing the acid group with a base.

The method of producing the toner of the present invention may include washing the solid particles with an acid after the step of forming the solid particles and before the step of washing the solid particles with the second solvent.

The method of producing the toner of the present invention may include adding silica after the step of washing the solid particles with the second solvent.

In the method of producing the toner of the present invention, the charge control agent may be at least one selected from the group consisting of a Nigrosine-based charge control agent, a Triphenylmethane-based charge control agent, and a quaternary ammonium salt-based charge control agent; and the second solvent may be alcohol having a number of carbon or carbons of 1 to 3.

In the method of producing the toner of the present invention, the alcohol may be methanol.

In the method of producing the toner of the present invention, the charge control agent may be a Nigrosine-based charge control agent or a Triphenylmethane-based charge control agent; and the second solvent may be methanol.

In the method of producing the toner of the present invention, the resin may be a polyester resin or a polyester-modified resin of styrene-acryl resin.

According to a third aspect of the present invention, there is provided a method of producing a toner, the method including: forming solid particles containing a charge control agent which is positively charged; and washing the solid particles with a solvent in which the charge control agent is dissoluble.

In the method of producing the toner of the present invention, the charge control agent may be a Nigrosine-based charge control agent or a Triphenylmethane-based charge control agent; and the solvent may be methanol.

In the method of producing the toner of the present invention, the solid particles may further include a resin and a colorant.

In the method of producing the toner of the present invention, the resin may be insoluble in the solvent.

BRIEF DESCRIPTION OF THE DRAWINGS

FIGS. 1A and 1B schematically show a structure of an apparatus used for measuring charge amount and fog, wherein FIG. 1A is a cross sectional view schematically showing the structure of a developing unit, and FIG. 1B is a schematic diagram explaining the structure of a Faraday cage;

DESCRIPTION OF THE PREFERRED EMBODIMENTS

Figure 1A:
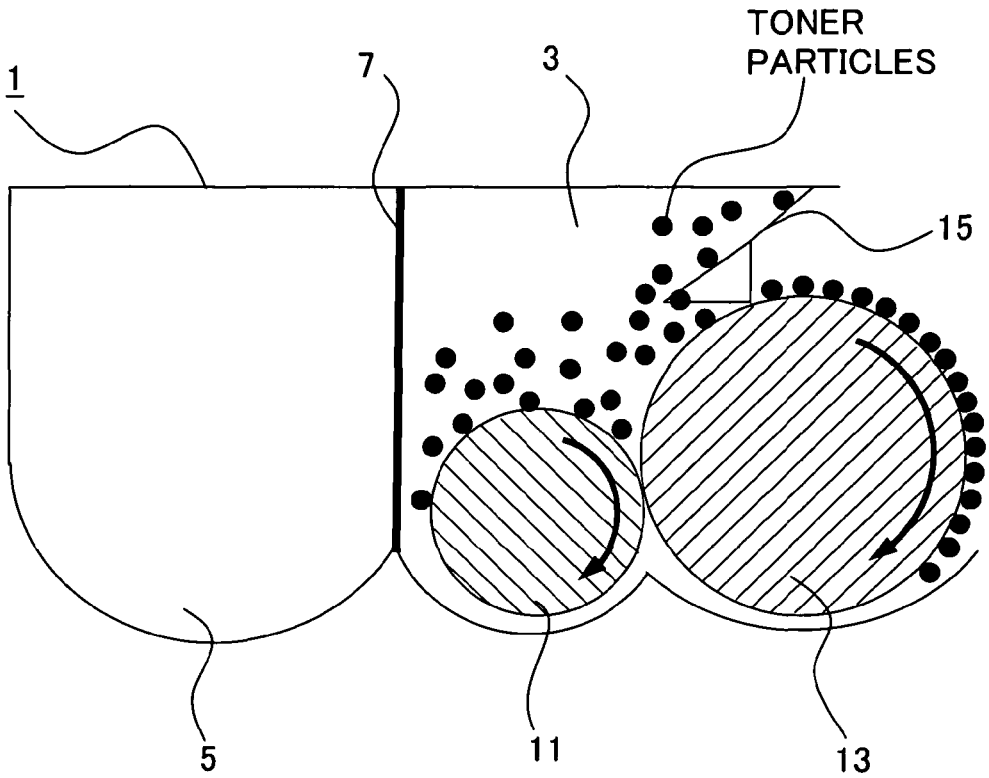

In the present invention, a resin with an acid group means a self-dispersible resin which is ionized with its acid group being neutralized by a base, thereby stably dispersing in an aqueous dispersion medium, without using any emulsifying agent or the like. Specifically, it is possible to arbitrarily use a resin obtained by polymerizing polymerizable monomers with an acid group, or to arbitrarily use a resin obtained by copolymerizing polymerizable monomers with an acid group and polymerizable monomers having no acid group, and the like. For example, it is suitable to use an acid group-having polyester resin or styrene-acryl resin, or the like.

The first solvent, which is hydrophobic, is a solvent which is capable of dissolving, in relation to a selected resin, the selected resin. The first solvent also has hydrophobicity to the extent that the first solvent forms oil phase in the aqueous dispersion medium. It should be noted, however, that it is not necessarily indispensable that the solubility with respect to the aqueous dispersion medium is 0 (zero) provided that the first solvent substantially forms the oil phase in the aqueous dispersion medium. Specific examples of such a first solvent may include methyl ethyl ketone, ethyl acetate, toluene, benzene and the like.

The colorant is a component which determines the color of toner particles, and various kinds of known dyes or pigments can be used as a toner material (ingredient). More specifically, it is possible to use various kinds of the pigments or oil-soluble dyes such as Zinc yellow, Iron oxide yellow, Hansa yellow, Disazo yellow, Quinoline yellow, Permanent yellow, Permanent red, Red iron oxide, Lithol red, Pyrazolone red, Lake Red C, Lake Red D, Brilliant carmine 6B, Brilliant carmine 3B, Prussian blue, Phthalocyanine blue, Metal-free phthalocyanine, Titanium oxide, Carbon Black, and the like.

The charge control agent which is positively charged is added so as to impart the toner particles with the positive chargeability. More specifically, it is desired that the charge control agent is at least one selected from those of a Nigrosine-based charge control agent, a Triphenylmethane-based charge control agent, and a quaternary ammonium salt-based charge control agent. Since these charge control agents includes colored (chromatic) and colorless (achromatic) agents, an agent, having a suitable tint in relation to the colorant such that the agent does not hinder the coloring of the final toner, is selected. For example, for a black toner, even using the colored charge control agent, there is no substantial effects on the coloring of the toner. Accordingly, any of the Nigrosine-based charge control agent, Triphenylmethane-based charge control agent and quaternary ammonium salt-based charge control agent may be used. On the other hand, for a color toner, the quaternary ammonium salt-based charge control agent is suitable.

The base may be any types of base which makes the aqueous solution basic. For example, hydroxide of alkali metal or the like can be used. Normally, the aqueous solution may be water.

In the first step, an emulsion composed of: liquid droplets containing the resin with the acid group, the first solvent, the colorant and the charge control agent; and the aqueous solution in which the liquid droplets are dispersed, is formed. This step may also include neutralizing the acid group with a base. Such an emulsion can be formed also by, for example, agitating and mixing component(s) to be oil phase (the resin, first solvent, colorant and charge control agent) with component(s) to be aqueous phase (aqueous dispersion medium) while adding the base inside the system; or by adding the base to the component to be the oil phase and performing the agitation and mixing, and then by adding the components to be the aqueous phase into the system. Alternatively, the emulsion can be formed by adding the base to the component to be the aqueous phase and performing the agitation and mixing, and then by adding the components to be the oil phase into the system. Further, the order of adding and mixing the components to be the oil phase may be arbitrary, and it is possible to first mix a part of the components to be the oil phase with the component to be the aqueous phase, and then the remaining part of the components to be the oil phase may be added to the system. In other words, "the emulsion composed of liquid droplets containing the resin with the acid group, the first solvent, the colorant and the charge control agent; and the aqueous solution in which the liquid droplets are dispersed" can be formed without strictly determining the order of adding each of the components.

After finishing the step of forming the emulsion in this manner, solid particles obtained by solidifying the liquid droplets are formed in the next step by removing the first solvent from the liquid droplets in the emulsion. The methods for removing the first solvent may includes, for example, a method of raising the temperature of the liquid droplets by heating; a method by decompression, or a method using the heating and decompression in combination, so that the first solvent is vaporized.

After forming the solid particles, the solid particles are simply washed with the second solvent, or the solid particles are first washed with an acid and then washed with the second solvent. Namely, although the step of washing the solid particles with the second solvent is essential (indispensable), it is arbitrary whether or not to include the step of washing the solid particles with the acid before the washing step with the second solvent.

When the solid particles are washed with acid, an acid is used which has acidity to an extent that is capable of reverting the acid group neutralized by the base to the original acid group (reverse-neutralization) and which has no harmful effects to the other components. Specific examples of such an acid include, for example, hydrochloric acid, sulfuric acid, and nitric acid. Any one of these acids may be suitably diluted to be used. In a case that this acid-treatment step is not included, the acid groups on the surface of the toner particles as a final product remain as salts. As a result, there occurs a tendency that the hygroscopic property (moisture-absorption characteristics) of the toner becomes high. Accordingly, when the hygroscopic property of the toner is not considered as a problem, the acid-treatment step may be omitted. On the other hand, when the hygroscopic property of the toner is considered as a problem, it is desired to include the acid-treatment step.

The step of washing the solid particles with the second solvent is the most characteristic step in the present invention. In this washing step, as the second solvent, a solvent in which the charge control agent in the solid particles obtained in the preceding step is dissoluble and the resin in the solid particles is insoluble is used. It should be noted, however, that the phrase "in which the resin in the solid particles is insoluble" means that the resin is not dissolved to such an extent that any morphology change of the solid particles occurs before and after the washing, but the phrase does not mean that even a trace amount of any low-molecular weight component is not eluted from the resin. Rather, it is regarded quite natural, regardless of the kinds of the solvent, that the resin contains a low-molecular weight component in a trace amount, and that a part of such a low-molecular weight component is eluted to the solvent. Accordingly, it is not necessarily indispensable that "the second solvent which does not dissolve the resin" is a solvent which does not dissolve a trace amount of the low-molecular weight component as described above.

As the second solvent, a solvent is selected, in relation to the charge control agent, such that the solvent is capable of dissolving the charge control agent. To provide a specific example, when the charge control agent is at least one selected from those of a Nigrosine-based charge control agent, a Triphenylmethane-based charge control agent, and a quaternary ammonium salt-based charge control agent, it is desired that the second solvent is alcohol having a number of carbon or carbons of 1 to 3 (namely, methanol, ethanol, 1-propanol, 2-propanol). In particular, when considering the easier drying, it is more suitable as the alcohol has lower molecular weight. Further, when considering low cost and easier industrial applicability, methanol is most preferred.

When the solid particles are washed by using the second solvent as described above, the positive chargeability of the toner particles finally obtained is improved. This effect has been confirmed by the inventors through the experiments. Although the cause, that the positive chargeability of the toner is improved, is a hypothesis so far, the following reason is conceivable.

Namely, the solid particles, before being washed with the second solvent, are the liquid droplets before the solidification, and the liquid droplets are self-dispersed in the aqueous dispersion medium in a state that the outer surface of liquid droplets is hydrophilic and the inner portion of the liquid droplets is hydrophobic, as explained in the "Background of Invention" section. Namely, on the outer layer of the solid particle, the acid groups exist more densely than those existing in the inner portion of the solid particle, and thus sites of negative polarity exist on the outer layer of the solid particles by a quite large amount. It is considered that, for this reason, even when the charge control agent which is positively charged is blended to the solid particles as a whole, the charge control agent is affected by the sites of negative polarity quantitively dominant on the outer layer of the solid particles, which in turn causes the positive charge amount to be low as a result.

On the other hand, it is conceived that when washing the solid particles with the second solvent as described above, a dissolvable portion, which is contained in the inner portion of the solid particles and which can be dissolved by the second solvent, is dissolved by the second solvent and moved to the outer surface of the solid particles so as to electrostatically adsorb to the sites of negative polarity existing on the outer layer of the solid particles, thereby electrically neutralizing the sites of negative polarity existing on the outer layer of the solid particles, causing the positive charge amount to be high as a result.

There is a possibility that any other causes exist in addition to the above cause. In any case, however, even when the solid particles are low in the positive chargeability before being washed with the second solvent, it is confirmed by the experiments conducted by the inventors that the solid particles are high in the positive chargeability after being washed with the second solvent.

According to the results of experiments conducted and confirmed by the inventors, in the step of washing the solid particles with the second solvent, it is desired to optimize the amount of the second solvent in the relation to the amount of the charge control agent, considering the solubility (elutability) of the charge control agent to the second solvent.

Specifically, for example, when the solubility of the charge control agent to the second solvent is less than 1, it is desired that the amount of the second solvent, used in the step of washing the solid particles, is not less than 500 by a weight ratio thereof to the amount of the charge control agent (second solvent/charge control agent). On the other hand, when the solubility of the charge control agent to the second solvent is not less than 1, it is desired that the amount of the second solvent, used in the step of washing the solid particles, is not less than 150 by the weight ratio thereof to the amount of the charge control agent (second solvent/charge control agent). In each of the cases, when the amount of the second solvent by the weight ratio to the charge control agent is less than the lower limit, the effect obtained by washing the solid particles with the second solvent becomes weak.

On the other hand, when the amount of the second solvent by the weight ratio to the charge control agent is not less than the lower limit, the effect can be appropriately obtained. Thus, there is no limitation to the upper limit. However, even when using the second solvent in an unduly excessive amount, the effect is not necessarily obtained limitlessly. Accordingly, considering the condition in which the effect reaches the peak, the amount of the second solvent, used in the step of washing the solid particles, may be not more than 1,000 by a weight ratio of the second solvent to the charge control agent (second solvent/charge control agent).

The solid particles, obtained through the steps as described above, are subjected to other treatment such as drying and the like in accordance with a routine procedure, are added with various kinds of additives as necessary, and are made to be toner particles. As an additive for improving the fluidity, silica is generally used.

When the additive such as silica is added, the solid particles which have not been subject to the washing with the second solvent have a problem such that the solid particles exhibit the above-described tendency of low charge amount more prominently. The cause to this is conceived as follows. Namely, the addition of the additive such as silica improves the fluidity of the toner, which results in that the chance for the solid particles to mutually contact with each other or the solid particles contact with other component(s) (for example, additive(s)) is increased, and thus the chance for the solid particles to be charged is increased. Accordingly, while the influence of the sites of negative polarity which are quantitively dominant becomes great, the electric charge of the charge control agent present in a trace amount on the outer surface of the solid particles has already saturated and thus the influence of the charge control agent becomes relatively small, thereby rendering the negative chargeability becomes high in the solid particles as a whole. On the other hand, when the solid particles are washed with the second solvent, as described above, the sites of negative polarity existing on the outer surface of the solid particles are electrically neutralized. Accordingly, it is possible to make the positive charge amount in the solid particles to be sufficiently high. Thus, in the present invention, it is particularly important to provide the step of washing the solid particles with the second solvent when providing the step of adding silica.

In the following, the present invention will be explained by examples.

(1) Steps for Producing Toner

Toner Samples corresponding to examples of the present invention were produced by the following steps.

First of all, in the first step, an emulsion was formed by dispersing, in an aqueous dispersion medium, liquid droplets which contain a resin with acid group, a first solvent which is hydrophobic and in which the resin is dissoluble, a colorant, and a charge control agent which is positively charged, and in which the acid group is neutralized by a base.

Specifically, at first, a polyester resin (polyester resin XPE 2443 manufactured by Mitsui Chemicals; corresponding to "resin with an acid group" in the present invention; the acid group: carboxyl group), methyl ethyl ketone (corresponding to "first solvent" in the present invention), Carbon black (Carbon black #260 manufactured by Mitsubishi Chemical Corporation; corresponding to "colorant" in the present invention), a Nigrosine-based charge control agent (any one of Bontron N01, Bontron N04, Bontron N07, Bontron N21 manufactured by Orient Chemical Industries, Ltd; corresponding to "charge control agent which is positively charged" in the present invention, will be explained in detail later on) were mixed to prepare a composition which is to be oil phase (mix proportion: methyl ethyl ketone 78.8%, polyester resin 20%, Carbon black 1%, and charge control agent 0.2%).

134.5 g of the composition to be the oil phase and 314 g of distilled water (corresponding to "aqueous dispersion medium" in the present invention) were put in a separable flask (500 ml, with 4 pieces of baffle plates (74×10 mm)), and agitated with a turbine-mixer having 6 flat blades (diameter: 50 mm; mixing position: 2.5 cm from the flask bottom; agitation speed: 400 rpm).

Subsequently, when 1 minute elapsed after the start of agitation, 1.35 g of 1 mol/L-sodium hydroxide aqueous solution (corresponding to "base" in the present invention) was added, and then the agitation was performed further for 9 minutes, thereby forming an emulsion in which oil-phase droplets having a mean diameter of about 10 μm are dispersed in the water.

Next, in the second step, the first solvent was removed from the liquid droplets in the emulsion obtained in the first step to solidify the liquid droplets, thereby forming the solid particles.

Specifically, at first, the emulsion was moved (transferred) into a round bottom flask immersed in a hot-water bath of 60° C. and was agitated by the agitating blades (mixing rotation speed: 120 rpm) for 1.5 hours while blowing air thereonto, so that the emulsion as a whole loosely flowed. Then, methyl ethyl ketone was removed from the oil phase-liquid droplets, thereby making the oil-phase liquid droplets to be solidified particles.

Afterwards, the suspension containing the solidified particles was transferred to a beaker, which was then immersed in a cold water and subjected to agitation to an extent that the solid particles were not deposited, while cooling the suspension until the temperature of the suspension was lowered to 25° C.

Next, in the third step, the solid particles obtained in the second step were washed with an acid.

Specifically, the suspension obtained in the second step was added with 3 g of 1 mol/L-Hydrochloric Acid (corresponding to "acid" in the present invention), and the agitation was continued for 30 minutes. Then, the suspension was subjected to filtration, and then 300 g of the distilled water was added to the suspension and the washing/filtration was continued.

Next, in the fourth step, the second solvent, in which the charge control agent is dissoluble and the resin is insoluble was used to wash the solid particles which had been subjected to the acid treatment in the third step.

Specifically, the solid particles filtrated in the third step were put in a beaker (any one of beakers of 300 ml to 1,000 ml) containing alcohol (methanol in the examples; corresponding to "second solvent" in the present invention), and the beaker was covered with a volatilization-preventing wrapper. Then, the solid particles were agitated with a turbine-mixer having 6 flat blades (diameter: 50 to 75 mm; mixing position: 2.5 cm from the beaker bottom; agitation speed: 200 to 400 rpm) to an extent to that the mixture of the solid particles and alcohol flowed as a whole. The amount of the alcohol and the agitation time will be explained later on.

Afterwards, the solid particles were left to stand for 1 hour, and then subjected to filtration gently from the supernatant, thereby obtaining the solid particles treated with alcohol.

Next, in the fifth step, silica was added to the solid particles which had been subjected to the alcohol treatment in the fourth step.

Specifically, the solid particles, subjected to the alcohol treatment in the fourth step, were dried in a drier at temperature of 50° C., and then 1 part by weight of silica fine particles (HVK 2150 manufactured by Clariant (JAPAN) K. K.) with respect to 100 parts by weight of the solid particles. Thus, the toner samples corresponding to the examples of the present invention were obtained.

In the producing steps as explained above, Samples 1 to 20 which differ mutually in the combination of following conditions (I) to (III) were produced. (I) The charge control agent used is any of the following charge control agents each manufactured by Orient Chemical Industries, Ltd, namely: Bontron N01 (trade name) which is an azine compound (Nigrosine-based, pH 7); Bontron N04 (trade name) which is an azine compound obtained by modifying Bontron N01 with a maleic acid-based resin; Bontron N07 (trade name) which is an azine compound (Nigrosine-based, pH 5); and Bontron N21 (trade name) which is an azine compound obtained by modifying Bontron N01 with an alkylbenzene sulfonate. (II) The amount of alcohol used for the respective samples was changed in a plurality of ways. (III) The agitation time (duration) of the alcohol for the respective samples was changed in a plurality of ways. Thus, Samples 1 to 20 mutually different in the combination of these conditions (I) to (III) were produced (see TABLE 1).

Further, Sample 30 was produced by replacing the Nigrosine-based charge control agent with a Triphenylmethane-based charge control agent (Copy Blue PR, manufactured by Hoechst Aktiengesellschaft) as the charge control agent which is positively-charged and mixed in the first step; by forming the solid particles in the identical procedures as in the first, second and third steps; by washing the solid particles in the similar procedure in the fourth step except that the amount of methanol was 60 g and the agitation time was 30 minutes; and by adding silica in the identical procedure as in the fifth step (see TABLE 1).

Furthermore, Sample 40 was produced by replacing the polyester resin with a polyester-modified resin of styrene-acryl resin (Himer SB514, produced by Sanyou Chemical Industries, Ltd.; acid value: 5.5 mg.KOH; glass transition point (Tg): 62.1° C.), as the resin with an acid group mixed in the first step; and by using Bontron N21 as the charge control agent which is positively charged and mixed in the first step; by forming the solid particles in the identical procedures as in the first, second and third steps; by washing the solid particles in the similar procedure in the fourth step except that the amount of methanol was 60 g and the agitation time was 30 minutes; and by adding silica in the identical procedure as in the fifth step (see TABLE 1).

In addition to Samples 1-20, 30 and 40 corresponding to Examples, Samples 21-28, 31-32 and 41-42 which serve as Comparative Examples were also produced by the procedures as explained below (see TABLE 1).

Samples 21 to 24 were obtained by using Bontron N01, Bontron N04, Bontron N07 and Bontron N21, manufactured by Orient Chemical Industries, Ltd respectively, as the charge control agent; and by performing the first, second, third, and fifth steps in this order. Namely, Samples 21 to 24 are different from Samples 1 to 20 in that no alcohol treatment (corresponding to the fourth step) was performed for Samples 21 to 24.

Sample 31 was obtained by using Copy Blue PR, manufactured by Hoechst Aktiengesellschaft, as the charge control agent; and by performing the first, second, third, and fifth steps in this order. Namely, Sample 31 is different from Sample 30 in that no alcohol treatment (corresponding to the fourth step) was performed for Sample 31.

Sample 41 was obtained by using polyester-modified resin of styrene-acryl resin (Himer SB514, produced by Sanyou Chemical Industries) as the resin with an acid group; by using Bontron N21 manufactured by Orient Chemical Industries, Ltd. as the charge control agent; and by performing the first, second, third, and fifth steps in this order. Namely, Sample 41 is different from Sample 40 in that no alcohol treatment (corresponding to the fourth step) was performed for Sample 41.

Samples 25 to 27 used Bontron N21 manufactured by Orient Chemical Industries, Ltd. as the charge control agent; and Samples 25 to 27 were prepared in the following procedures, respectively.

First, emulsion was formed by the procedure having the same condition and order as in the first step except that no charge control agent was added. Afterwards, the solid particles were formed by the identical procedures as those in the second and third steps. Namely, the solid particles containing no charge control agent were formed.

On the other hand, 0.269 g of Bontron N01 manufactured by Orient Chemical Industries, Ltd. and methanol were put in a beaker of 500 ml, and were agitated for 1 hour to an extent that the fluid as a whole flowed. The amount of methanol was 120 g for Sample 25, 240 g for Sample 26, and 480 g for Sample 27.

In each of Samples 25 to 27, the solid particles containing no charge control agent were placed in the methanol solution of the charge control agent; and then the beaker was covered with the wrapper for preventing volatilization; and were subjected to agitation for 30 minutes with a turbine-mixer having 6 flat blades (diameter: 50 to 70 mm; mixing position: 2.5 cm from the beaker bottom; agitation speed: 200 to 400 rpm) to an extent that the solution as a whole flowed. Afterwards, the solution was left to stand for 1 hour, and then subjected to filtration gently from the supernatant, thereby obtaining the solid particles treated with the methanol solution of the charge control agent.

Then, in the same manner as the fifth step, the silica was added, thereby obtaining Samples 25 to 27. Namely, Samples 25 to 27 were not blended with the charge control agent in the step of forming the solid particles themselves. Rather, a treatment was performed for each of Samples 25 to 27 such that when the alcohol treatment was performed to the solid particles, the charge control agent was dissolved in the alcohol so that the charge control agent was dyed onto the solid particles.

Sample 28 was produced as the same procedure and condition as those for Samples 25 to 27 except that Bontron N21 manufactured by Orient Chemical Industries, Ltd. was used as the charge control agent, and that the amount of methanol was 240 g. Namely, Sample 28 also was not added with any charge control agent in the step of forming the solid particles themselves. Rather, a treatment was performed for Sample 28 such that when the alcohol treatment was performed to the solid particles, the charge control agent was dissolved in the alcohol so that the charge control agent was dyed onto the solid particles. Therefore, Sample 28 differs from Sample 26 only in the charge control agent used for the production thereof.

Sample 32 was produced as the same procedure and condition as those for Samples 25 to 27 except that Copy Blue PR, manufactured by Hoechst Aktiengesellschaft was used as the charge control agent, and that the amount of methanol was 60 g. Namely, Sample 32 also was not added with any charge control agent in the step of forming the solid particles themselves. Rather, a treatment was performed for Sample 32 such that when the alcohol treatment was performed to the solid particles, the charge control agent was dissolved in the alcohol so that the charge control agent was dyed onto the solid particles.

Further, Sample 42 was produced as the same procedure and condition as those for Samples 25 to 27 except that Bontron N21 manufactured by Orient Chemical Industries, Ltd. was used as the charge control agent; that Himer SB514, produced by Sanyou Chemical Industries, Ltd., which is a polyester-modified resin of styrene-acryl resin was used as the resin with an acid group; and that the amount of methanol was 60 g. Namely, Sample 42 also was not added with any charge control agent in the step of forming the solid particles themselves. Rather, a treatment was performed for Sample 42 such that when the alcohol treatment was performed to the solid particles, the charge control agent was dissolved in the alcohol so that the charge control agent was dyed onto the solid particles.

In the following TABLE 1, the production conditions for Samples 1-28, 30-32 and 40-42 are collectively indicated.

TABLE 1

| | | | Charge control agent | | Methanol | | | |
|---|---|---|---|---|---|---|---|---|
| | Sample | Resin Name | Name | Blend Method | Usage | Amount (g) | Wt. Ratio (MeOH/CCA) | Agitation time (min.) |
| EXAMPLES | 1 | XPE2443 | BONTRON N01 | Blending in the solid particles | Singly used | 75 | 279 | 30 |
| | 2 | XPE2443 | BONTRON N01 | | | 120 | 446 | 30 |
| | 3 | XPE2443 | BONTRON N01 | | | 150 | 558 | 30 |
| | 4 | XPE2443 | BONTRON N01 | | | 180 | 669 | 30 |
| | 5 | XPE2443 | BONTRON N01 | | | 240 | 893 | 30 |
| | 6 | XPE2443 | BONTRON N01 | | | 300 | 1116 | 30 |
| | 7 | XPE2443 | BONTRON N01 | | | 360 | 1339 | 30 |
| | 8 | XPE2443 | BONTRON N01 | | | 75 | 279 | 5 |
| | 9 | XPE2443 | BONTRON N01 | | | 150 | 558 | 5 |
| | 10 | XPE2443 | BONTRON N01 | | | 240 | 893 | 5 |
| | 11 | XPE2443 | BONTRON N01 | | | 300 | 1116 | 5 |
| | 12 | XPE2443 | BONTRON N01 | | | 360 | 1339 | 5 |
| | 13 | XPE2443 | BONTRON N01 | | | 150 | 558 | 15 |
| | 14 | XPE2443 | BONTRON N01 | | | 150 | 558 | 60 |
| | 15 | XPE2443 | BONTRON N04 | | | 40 | 149 | 30 |
| | 16 | XPE2443 | BONTRON N04 | | | 75 | 279 | 30 |
| | 17 | XPE2443 | BONTRON N07 | | | 40 | 149 | 30 |
| | 18 | XPE2443 | BONTRON N07 | | | 75 | 279 | 30 |
| | 19 | XPE2443 | BONTRON N21 | | | 40 | 149 | 30 |
| | 20 | XPE2443 | BONTRON N21 | | | 75 | 279 | 30 |
| | 30 | XPE2443 | Copy blue PR | | | 60 | 223 | 30 |
| | 40 | Himer SB514 | BONTRON N21 | | | 60 | 223 | 30 |
| COM. EXAMPLES | 21 | XPE2443 | BONTRON N01 | | Not used | — | — | — |
| | 22 | XPE2443 | BONTRON N04 | | | — | — | — |
| | 23 | XPE2443 | BONTRON N07 | | | — | — | — |
| | 24 | XPE2443 | BONTRON N21 | | | — | — | — |
| | 31 | XPE2443 | Copy blue PR | | | — | — | — |
| | 41 | Himer SB514 | BONTRON N21 | | | — | — | — |
| | 25 | XPE2443 | BONTRON N01 | Dyeing | (*) | 120 | 446 | 30 |
| | 26 | XPE2443 | BONTRON N01 | | | 240 | 893 | 30 |
| | 27 | XPE2443 | BONTRON N01 | | | 480 | 1785 | 30 |
| | 28 | XPE2443 | BONTRON N21 | | | 240 | 893 | 30 |
| | 32 | XPE2443 | Copy blue PR | | | 60 | 223 | 30 |
| | 42 | Himer SB514 | BONTRON N21 | | | 60 | 223 | 30 |

(*) Used with the charge control agent (2) Method of Measuring Physical Property of Toner The physical properties of each of Samples 1-28, 30-32 and 40-42 produced by the above-mentioned procedures were measured by the following method.

Method of Measuring Electric Charge Amount

A developing unit of a laser printer (HL1850 manufactured by Brother Kogyo Kabushiki Kaisha) was modified and used for the measurement. Specifically, as shown in FIG. 1A, the developing unit was used in which a partition 7 was provided between a developing chamber 3 and a toner chamber 5 in a developing unit 1, in order to decrease an amount of toner to be used for the evaluation.

15 g of each of the toner samples (Samples 1-28, 30-32 and 40-42) is filled (packed) in the developing unit 1, the developing unit 1 is attached to the laser printer, and a feeding roller 11 (formed of urethane foam) and a developing roller 13 (formed of silicon rubber) are rotated for about 1 minute. The packed toner is transferred to the developing roller 13 by the rotation of the feed roller 11, and then the toner is pressed onto the developing roller 13 by making a contact with a tip formed of silicon rubber attached to an end of a blade 15, and thus the toner is supported in a state of thin layer on the developing roller 13.

Figure 1B:
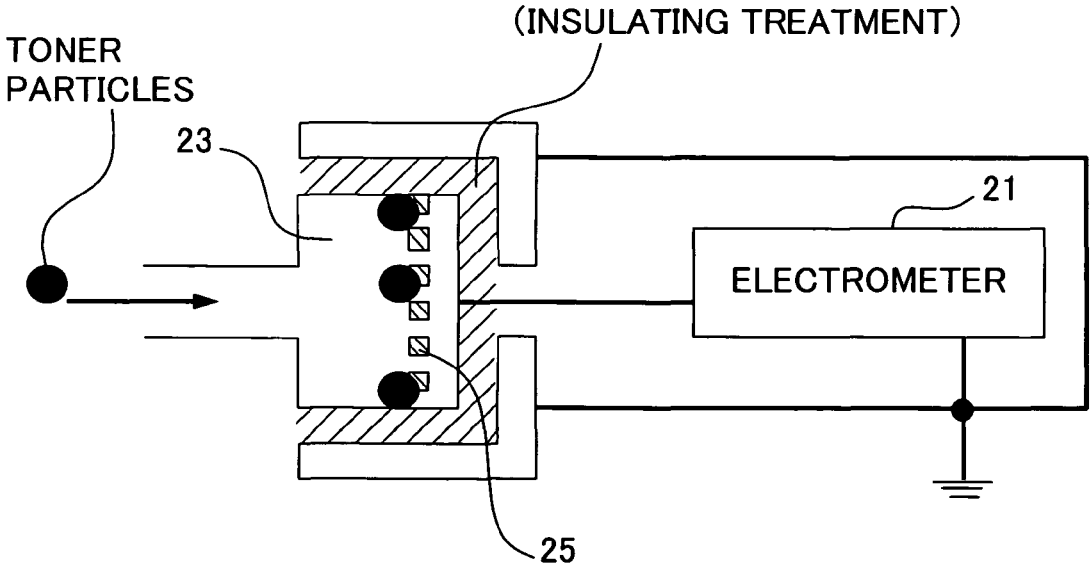

Then, about 5 $cm^2$ (about 3 mg) of the toner thin layer formed on the developing roller 13 is sucked into a Faraday cage 23 connected to an electrometer 21 (Model 617 Programmable Electrometer, manufactured by Keithley Instruments Inc.) as shown in FIG. 1B.

A filter 25 (glass fiber filter paper GS25 manufactured by Advantec Toyo Kaisha, Ltd.) for trapping the sucked toner is provided in the inside of the Faraday cage 23. A portion of the Faraday cage in which the filter 25 is provided is connected to the electrometer 21 in an insulated state (not grounded) so that the accumulated charge is not discharged. In other words, it is constructed such that the accumulated charge of the toner trapped by the filter 25 in the Faraday cage 23 can be measured by the electrometer 21.

The toner, formed in a thin layered state on the developing roller 13 in such a manner, is sucked in the Faraday cage 23, and the accumulated charge is measured. Afterwards, the weight of the toner trapped in the filter 25 is measured, thereby calculating an electric charge amount per unit weight of the toner (μC/g).

Method of Measuring Fog

Fog was measured in the following method. Namely, measurements were performed for a whiteness (brightness) of a pre-use (virgin) sheet of printing paper and a whiteness of a sheet of the printing paper fed in the laser printer while performing a blank printing with blank printing data being transmitted to the laser printer. Then, by the difference in whiteness between these two sheets, the fog was quantified.

More specifically, upon measuring the whiteness, TC-6MC green lamp (manufactured by Tokyo Denshoku Co., Ltd.) was used; the whiteness was measured at three location randomly chosen in the sheet of printing paper; and the mean value among the measurements in the three locations was obtained as the whiteness of the measured object. First, the whiteness of virgin sheet of printing paper (4200 20 lb paper manufactured by Xerox) was measured (the measured value is hereinafter referred to as "measurement value a"). Afterwards, the whiteness of sheet of the printing paper (4200 20lb paper manufactured by Xerox) fed in the laser printer while transmitting blank printing data (hereinafter referred to as "blank printing sample") to the laser printer, to which the developing unit 1 used in the measurement of charge amount was attached, was measured (the measured value is hereinafter referred to as "measurement value b"). The difference in whiteness (b-a) between the blank printing sample and the virgin sheet was considered (identified) as "fog". This fog is an index indicating that as the difference in whiteness (b-a) between the blank sample and virgin sheet is smaller, the printing quality is higher.

The measurement results of the charge amount and the fog regarding each of Samples 1-28, 30-32 and 40-42 are indicated in TABLE 2 as follows.

TABLE 2

| | Sample | Charge amount Q/M (μC/g) | Fog (Difference in whiteness) |
|---|---|---|---|
| EXAMPLES | 1 | 0.4 | 8.99 |
| | 2 | 6.3 | 3.50 |
| | 3 | 13.8 | 1.49 |
| | 4 | 16.8 | 1.21 |
| | 5 | 27.3 | 0.93 |
| | 6 | 30.9 | 0.52 |
| | 7 | 30.0 | 0.59 |
| | 8 | 9.0 | 2.03 |
| | 9 | 22.8 | 0.52 |
| | 10 | 20.4 | 0.48 |
| | 11 | 17.2 | 0.27 |
| | 12 | 16.2 | 0.36 |
| | 13 | 14.5 | 1.52 |
| | 14 | 17.9 | 1.40 |
| | 15 | 46.0 | 1.01 |
| | 16 | 30.5 | 0.88 |
| | 17 | 37.9 | 1.53 |
| | 18 | 48.7 | 1.20 |
| | 19 | 43.3 | 0.95 |
| | 20 | 48.3 | 0.43 |
| | 30 | 14.8 | 1.38 |
| | 40 | 63.4 | 0.56 |
| COMPARATIVE EXAMPLES | 21 | −5.5 | 14.49 |
| | 22 | −7.8 | 24.63 |
| | 23 | −13.3 | 23.08 |
| | 24 | −19.0 | 18.50 |
| | 31 | −16.8 | 28.80 |
| | 41 | −5.5 | 9.50 |
| | 25 | 3.3 | 7.56 |
| | 26 | 18.1 | 4.83 |
| | 27 | 23.6 | 3.97 |
| | 28 | 22.3 | 1.46 |
| | 32 | 0 | 20.80 |
| | 42 | 25.9 | 3.41 |

(3) Method of Measuring Solubility of Charge Control Agent

The solubility was measured by the following method with respect to the four kinds of charge control agent, namely, Bontron N01, Bontron N04, Bontron N07 and Bontron N21 used for producing Samples 1-28 and 40-42.

2 g of each of the charge control agents was placed in an Erlenmeyer flask (50 ml) and subjected to a precise weighing. Next, 30 g of methanol was placed in the Erlenmeyer flask and subjected to a precise weighing.

Further, a stirring bar was placed in the Erlenmeyer flask, a lid was placed thereon, then ultrasonic dispersion was performed for 1 minute (ultrasound: 28 kHz, 650 W). Subsequently, agitation was performed for 2 hours with a magnetic stirrer such that the fluid as a whole flowed.

Subsequently, the flask was left to stand for 1 hour, and then 10 g of the supernatant was extracted to be subjected to centrifugal separation at 10,000 rpm for 30 minutes. Afterwards, 10 g of the supernatant after the centrifugal separation was precisely weighed (the weight is hereinafter referred to as "weight c") in an aluminum container (capacity: about 60 ml, area of opening: about 10 $cm^2$), and placed in a dryer at temperature of 50° C.

At a time of volatilization of the sample fluid (at a time when about 1 hour elapsed), the aluminum container was taken out of the dryer, was cooled to the room temperature, and then subjected to weighing. Then, the aluminum container was returned to the dryer, and the drying for not less than 30 minutes and the weighing was repeated for several times. When the weight change was reached at the value of less than 0.1% of after-volatilization residue (the charge control agent dissolved in the supernatant), then it was considered that the measurement reached the end point. The weight of the charge control agent contained in the supernatant after the centrifugal separation (dissolved portion) was considered (identified) as "weight d". Then, solubility "e" was calculated based on these weights c, d as follows:

$$\text{Solubility } e = d/c \times 100.$$

As a result, it was revealed that the solubility of Bontron N01 at the fluid temperature of 20° C. was 0.21 g; the solubility of Bontron N04 at the fluid temperature of 20° C. was 3.55 g; the solubility of Bontron N07 at the fluid temperature of 20° C. was 1.99 g; and the solubility of Bontron N21 at the fluid temperature of 20° C. was 5.07 g.

(4) Evaluation

From the evaluation results indicated in TABLE 2, it is appreciated that in Samples 1-20 corresponding to the examples of the present invention, the charge amount is 0.4 to 48.7 μC/g, and each of Samples 1-20 has a charge amount greater than those of Samples 21-24 as the comparative examples (in which the charge amount is −19.0 to −5.5 μC/g). In addition, in Samples 1-20, the fog (difference in whiteness) is 0.27 to 8.99, and each of Samples 1-20 has a fog value smaller than those of Samples 21-24 (in which the fog is 14.49 to 24.63). Since the difference between Samples 1-20 and Samples 21-24 is that whether or not the alcohol treatment was performed for the samples, it is appreciated from the results that the alcohol treatment improves the positive chargeability of toner particles.

On the other hand, Sample 30 using Copy Blue PR that is a Triphenylmethane-based charge control agent has a charge amount of 14.8 μC/g, which is greater than that of Sample 31 (charge amount: −16.8 μC/g) as a comparative example. In addition, in Sample 30, the fog (difference in whiteness) is 1.38, which is a value smaller than that in Sample 31 (fog: 28.80). The difference between Samples 30 and 31 is also whether or not the alcohol treatment was performed for the samples. Accordingly, it is appreciated from the results that even when a Triphenylmethane-based charge control agent is used as the charge control agent, the positive chargeability of toner particles are improved by performing the alcohol treatment.

In Sample 40, in which Himer SB514 that is a polyester-modified resin of styrene-acryl resin was used, the charge amount is 63.4 μC/g, which is greater than that in Sample 41 (charge amount: −5.5 μC/g) as a comparative example. In addition, in Sample 40, the fog (difference in whiteness) is 0.56, which is a value smaller than that in Sample 41 (fog: 9.50). The difference between Samples 40 and 41 is also whether or not the alcohol treatment was performed for the samples. Accordingly, it is appreciated from this results that even when a polyester-modified resin of styrene-acryl resin is used as the charge control agent, the positive chargeability of toner particles are improved by performing the alcohol treatment.

Regarding Samples 2 and 25, although each of these samples uses Bontron N01 as the charge control agent, and the amount of methanol used is 120 g, Sample 2 has a charge amount (6.3 μC/g) which is greater than that of Sample 25 (3.3 μC/g), and has a fog value (3.50) which is smaller than that of Sample 25 (7.56). Regarding Samples 5 and 26, although each of these samples uses Bontron N01 as the charge control agent, and the amount of methanol used is 240 g, Sample 5 has a charge amount (27.3 μC/g) which is greater than that of Sample 26 (18.1 μC/g), and has a fog value (0.93) which is smaller than that of Sample 26 (4.83). In Samples 25 and 26, the charge control agent was dissolved in the alcohol and the charge control agent was dyed with respect to the solid particles, rather than being blended in the solid particles. Accordingly, it is appreciated from the results that even when the charge control agent and alcohol were used in same amounts, respectively, the effect to improve the positive chargeability of the toner particles is enhanced when the charge control agent is first blended in the inside of the solid particles, and then the alcohol treatment is performed.

Regarding Samples 30 and 32, although each of these samples uses Copy Blue PR that is a Triphenylmethane-based charge control agent, and the amount of methanol used is 60 g, Sample 30 has a charge amount (14.8 μC/g) which is greater than that of Sample 32 (0 μC/g), and has a fog value (1.38) which is smaller than that of Sample 32 (20.80). In Sample 32, the charge control agent was dissolved in the alcohol and the charge control agent was dyed with respect to the solid particles, rather than being blended in the solid particles. Accordingly, it is appreciated from the results that even in a case that a Triphenylmethane-based charge control agent is used as the charge control agent, when the charge control agent and alcohol were used in same amounts, respectively, the effect to improve the positive chargeability of the toner particles is enhanced when the charge control agent is first blended in the inside of the solid particles, and then the alcohol treatment is performed.

Regarding Samples 40 and 42, although each of these samples uses Himer SB514 that is polyester-modified resin of styrene-acryl resin and Bontron N21 that is a Nigrosine-based charge control agent, and the amount of methanol used is 60 g, Sample 40 has a charge amount (63.4 μC/g) which is greater than that of Sample 42 (25.9 μC/g), and has a fog value (0.56) which is smaller than that of Sample 42 (3.41). In Sample 42, the charge control agent was dissolved in the alcohol and the charge control agent was dyed with respect to the solid particles, rather than being blended in the solid particles. Accordingly, it is appreciated from the results that even in a case that a polyester-modified resin of styrene-acryl resin is used as the resin, when the charge control agent and alcohol were used in same amounts, respectively, the effect to improve the positive chargeability of the toner particles is enhanced when the charge control agent is first blended in the inside of the solid particles, and then the alcohol treatment is performed.

Next, among the data indicated in TABLES 1 and 2, Samples using Bontron N01 as the charge control agent were selected and grouped into those for which the alcohol treatment was performed for 30 minutes (Samples 1-7); those for which the alcohol treatment was performed for 5 minutes (Samples 8-12); and those in which the charge control agent was dyed onto the solid particles (Samples 25-27). A graph (see FIG. 2A) for these three groups of Samples was created in which a weight ratio (MeOH/CCA) of methanol to the charge control agent is plotted in the horizontal axis, and the fog (difference in whiteness) is plotted in the vertical axis; and a graph (see FIG. 2B) for these three groups of Samples was created in which a weight ratio (MeOH/CCA) of methanol to the charge control agent is plotted in the horizontal axis, and the charge amount Q/M (unit: μC/g) is plotted in the vertical axis.

Figure 2A:
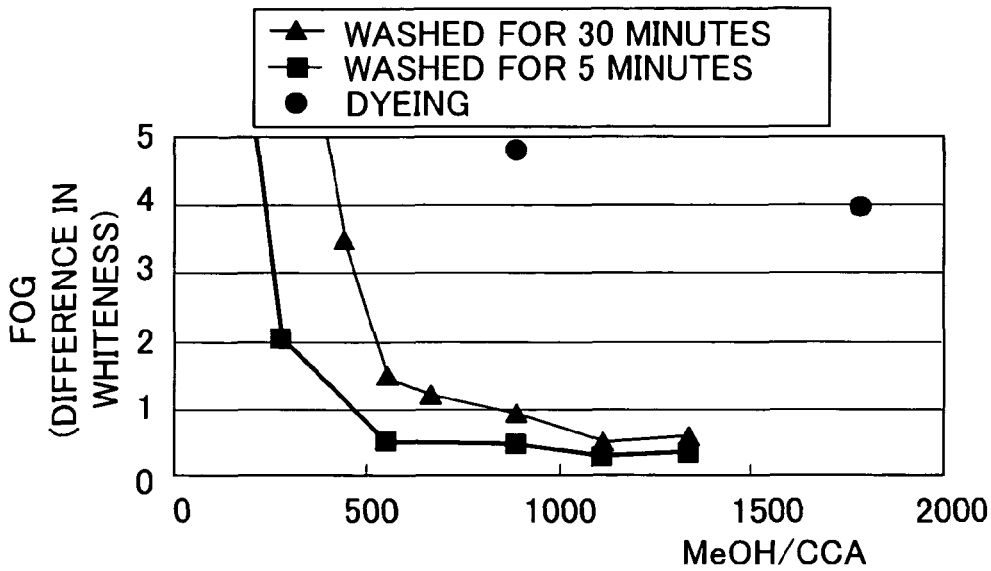
FIGS. 2A and 2B are graphs showing a relationship among the alcohol-treatment time, charge amount and fog.
Figure 2B:
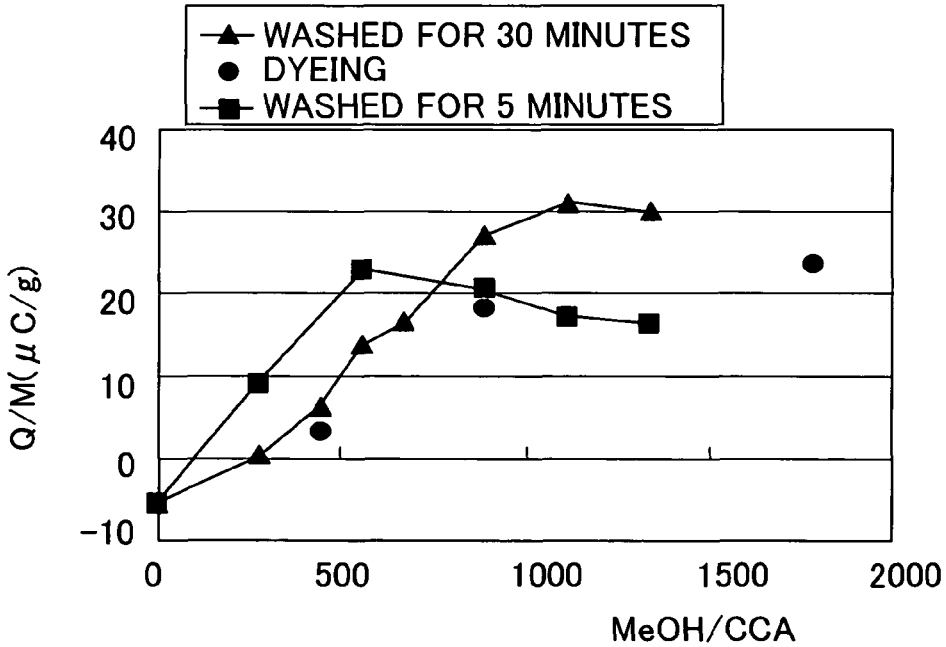

From the graphs shown in FIGS. 2A and 2B, it can be confirmed that that when at least Bontron N01 is used as the charge control agent, there is a tendency that the fog is suppressed and the charge amount is increased by performing the alcohol treatment.

Further, it is appreciated that there is no big difference in the duration of time for performing the alcohol treatment, and that the effect is sufficiently high even when the alcohol treatment was performed for 5 minutes.

Furthermore, it is appreciated that even when the charge control agent and the alcohol were used by same amounts, respectively, each of the samples in which the charge control agent was dyed has a greater fog value and has a smaller charge amount than the samples in which the charge control agent was blended in the solid particles. Therefore, it is appreciated that the alcohol treatment has the improved effects in increasing the charge amount and suppressing the fog than the dyeing.

There is a tendency that when the weight ratio of methanol to the charge control agent is extremely small, the effect becomes low. However, even when the weight ratio of methanol to the charge control agent is extremely great, the effects are not necessarily enhanced greatly. Accordingly, there is a suitable numerical value range. Degree to which the fog is to be suppressed can be changed depending on a target performance. However, as a criterion, when the fog generally is not more than 2, human eyes perceive or acknowledge this as a very satisfactory image quality. Accordingly, from the graph shown in FIG. 2A, it can be judged that a suitable weight ratio of methanol to the charge control agent is not less than 500. On the other hand, from the graph shown in FIGS. 2A and 2B, it is appreciated that even when the weight ratio of methanol to the charge control agent exceeds 1,000, the effect is saturated and there is little difference in the fog and charge amount. Also from this, it is considered that a sufficient effect can be obtained even when the weight ratio of methanol to the charge control agent is not more than 1,000, and thus methanol needs not to be used in an unnecessarily large amount. Namely, when the weight ratio of methanol to the charge control amount is set to be not less than 500 to not more than 1,000, it is desired because the chargeability can be sufficiently improved; the fog can be sufficiently suppressed; and the usage mount of alcohol can also be suppressed.

Next, among the data indicated in TABLES 1 and 2, Samples for which the alcohol treatment was performed for 30 minutes were selected and grouped into those for which Bontron N01 was used as the charge control agent (Samples 1-7); for which Bontron N04 was used as the charge control agent (Samples 15 and 16); those for which Bontron N07 was used as the charge control agent (Samples 17 and 18); those for which Bontron N21 was used as the charge control agent (Samples 19 and 20); and that for which Bontron N21 as the charge control agent was dyed onto the solid particles (Sample 28). A graph (see FIG. 3A) for these five groups of Samples was created in which a weight ratio (MeOH/CCA) of methanol to the charge control agent is plotted in the horizontal axis, and the fog (difference in whiteness) is plotted in the vertical axis; and a graph (see FIG. 3B) for these five groups of Samples was created in which a weight ratio (MeOH/CCA) of methanol to the charge control agent is plotted in the horizontal axis, and the charge amount Q/M (unit: μC/g) is plotted in the vertical axis.

Figure 3A:
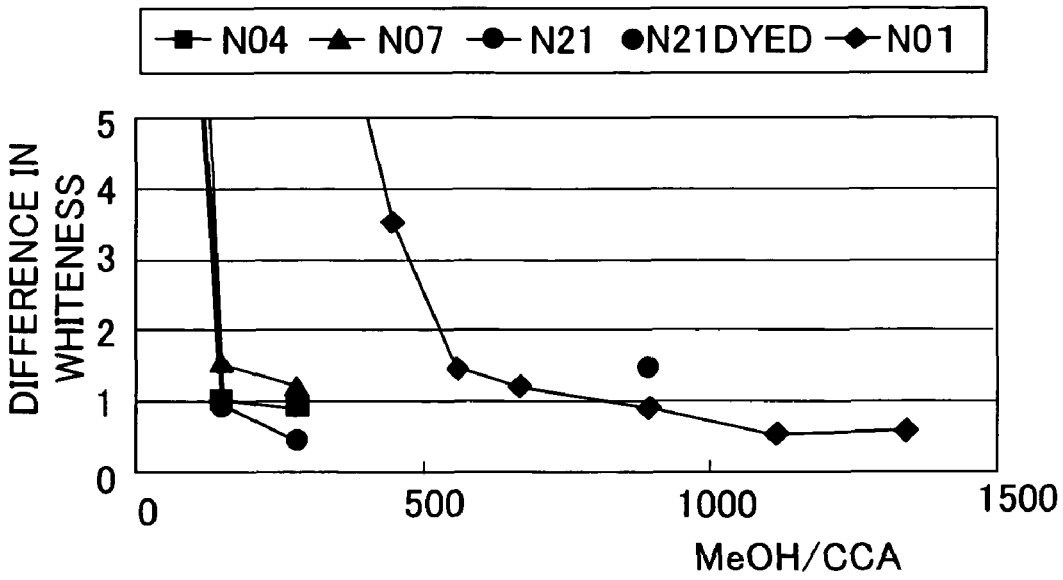
FIGS. 3A and 3B are graphs showing a relationship among the kind of charge control agent, charge amount and fog.
Figure 3B:
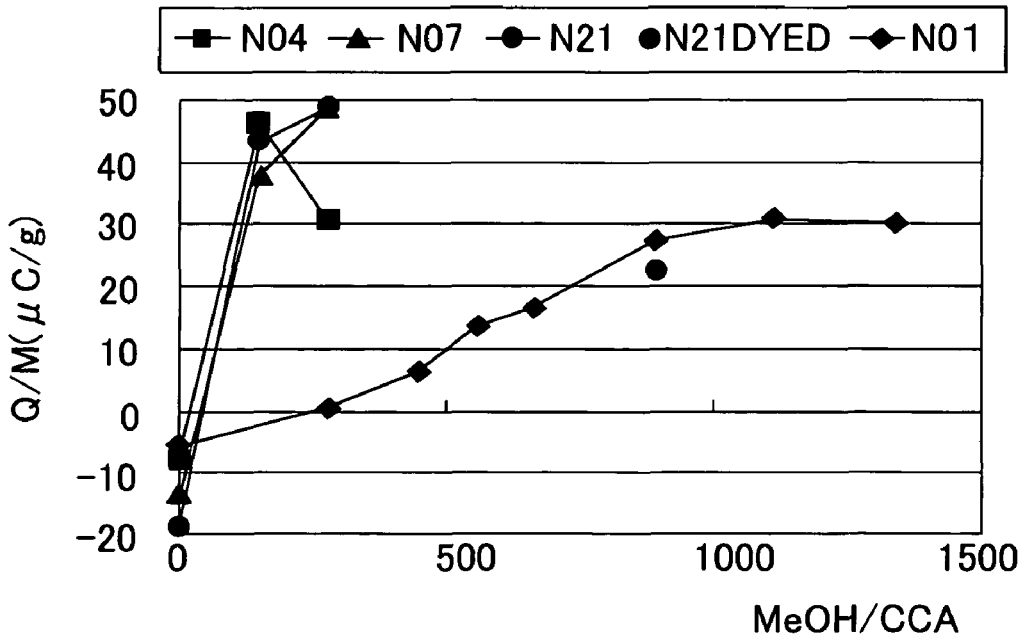

From the graphs shown in FIGS. 3A and 3B, it can be confirmed that that when a charge control agent having a high solubility is used (Bontron N04 having a solubility of 3.55 g/100 g MeOH; Bontron N07 having a solubility of 1.99 g/100 g MeOH; and Bontron N21 having a solubility of 5.07 g/100 g MeOH) is used, there is a tendency that the fog is sufficiently suppressed and the charge amount is increased even by performing the alcohol treatment using alcohol in an smaller amount.

Specifically, although it is considered that the weight ratio of methanol to the charge control agent is preferably not less than 500 from the graph shown in FIG. 2A as described above, it is possible to expect sufficient effect only by making the weight ratio of methanol to the charge control agent to be not less than 150 when Bontron N04, Bontron N07 and Bontron N21 are used as the charge control agent. It is conceived that the difference is caused due to the solubility of Bontron N01 which is low (0.21 g/100 g MeOH). Accordingly, when the solubility is less than 1, it is considered that the weight ratio of methanol to the charge control agent is preferably not less than 500 as described above. On the other hand, when the solubility is not less than 1, it is possible to expect sufficient effect only by making the weight ratio of methanol to the charge control agent to be not less than 150. Conversely, when the weight ratio of methanol to the charge control agent is made to be not less than 500, sufficient effect can be expected regardless of the solubility of charge control agent.

The present invention has been explained by the examples as described above. However, the present invention is not limited to the specific examples as described above, and can be applied in various kinds of forms other than the examples.

For example, each of the above-mentioned examples uses a specific product selected among the commercially available polyester resin or polyester-modified resin of styrene-acryl resin. However, a resin other than those exemplified in the above-described examples may be used provided that such a resin has a physical property suitable as a toner material and has an acid group.

Further, although each of the above-described examples uses methyl ethyl ketone as the first solvent, a solvent other than methyl ethyl ketone may be used as the first solvent, provided that such a solvent is a hydrophobic solvent in which the resin with the acid group is dissoluble. For example, ethyl acetate, toluene, benzene or the like may be used.

Further, although each of the above-described examples uses alcohol as the second solvent, a solvent other than alcohol may be used as the second solvent, provided that in such a solvent the charge control agent is dissoluble but the resin is insoluble. Further, in each of the above-described examples, methanol is the alcohol exemplified as the second solvent. However, alcohol other than methanol may be used provided that in such alcohol the charge control agent is dissoluble but the resin is insoluble. Specifically, lower alcohol having a number of carbon or carbons of 1 to 3, such as ethanol or propanol, is suitable to be used as the second solvent.

In each of the above-described examples, the Nigrosine-based charge control agent or Triphenylmethane-based charge control agent was used as an example of the positively-charged charge control agent. However, it is possible to use a charge control agent other than these agents, such as a quaternary ammonium salt-based charge control agent. In particular, for a color toner, the quaternary ammonium salt-based charge control agent is suitable to be used because the quaternary ammonium salt-based charge control agent hardly inhibits the coloring expressed by the colorant.

In each of the examples, Carbon black was used as the colorant. However, a colorant other than Carbon black may be used, and in the present invention, variety of kinds of known dyes or pigments can be used as the toner material.

Further, in each of the above-described examples, the emulsion was formed in the first step without using any surfactant. However, the emulsion may be formed by using a surfactant.

In the present invention, the solid particles obtained via a step of associating oil-phase liquid droplets in the emulsion or microparticles may be washed with the second solvent in which the charge control agent is dissoluble and the resin is insoluble.

Furthermore, in each of the above-described examples, the solid particles having the positively-charged charge control agent are formed by removing the solvent after the formation of the emulsion. However, the method for forming the solid particles having the positively-charged charge control agent is not limited to this method. The solid particles may be formed with an arbitrary method of producing solid particles having the positively charged charge control agent, such as the pulverizing method. Alternatively, commercially available solid particles may be obtained.

What is claimed is:

1. A method of producing a toner, the method comprising the steps of:

forming an emulsion having: liquid droplets containing a resin with an acid group, a first solvent which is hydrophobic and in which the resin is dissoluble, a colorant, and a charge control agent which is positively charged; and an aqueous dispersion medium which disperses the liquid droplets;

forming solid particles by removing the first solvent from the liquid droplets in the emulsion to solidify the liquid droplets; and washing the solid particles having the charge control agent with a second solvent in which the charge control agent is dissoluble and the resin is insoluble; and further comprising washing the solid particles with an acid after the step of forming the solid particles and before the step of washing the solid particles with the second solvent;

wherein the second solvent is an alcohol having a number of carbon or carbons of 1 to 3; and further comprising setting a weight ratio of the second solvent to the charge control agent to not less than 150 and not more than 1,000, except when a solubility of the charge control agent to the second solvent is less than 1, setting the weight ratio of the second solvent to the charge control agent to not less than 500 to not more than 1,000.

2. The method of producing the toner according to claim 1, wherein the step of forming the emulsion includes neutralizing the acid group with a base.

3. The method of producing the toner according to claim 1, further comprising adding silica after the step of washing the solid particles with the second solvent.

4. The method of producing the toner according to claim 1, wherein the charge control agent is at least one selected from the group consisting of a Nigrosine-based charge control agent, a Triphenylmethane-based charge control agent, and a quaternary ammonium salt-based charge control agent.

5. The method of producing the toner according to claim 4, wherein the alcohol is methanol.

6. The method of producing the toner according to claim 1, wherein the charge control agent is a Nigrosine-based charge control agent or a Triphenylmethane-based charge control agent; and the second solvent is methanol.

7. The method of producing the toner according to claim 1, wherein the resin is a polyester resin or a polyester-modified resin of styrene-acryl resin.

8. A method of producing a toner, the method comprising the steps of:

forming a emulsion having: liquid droplets containing a resin having a terminal group which is a carboxyl group, a first solvent which is hydrophobic and in which the resin is dissoluble, a colorant, and a charge control agent which is positively charged; and an aqueous dispersion medium which disperses the liquid droplets;

forming solid particles by removing the first solvent from the liquid droplets in the emulsion to solidify the liquid droplets; and washing the solid particles having the charge control agent with a second solvent in which the charge control agent is dissoluble and the resin is insoluble; and further comprising washing the solid particles with an acid after the step of forming the solid particles and before the step of washing the solid particles with the second solvent; the second solvent is an alcohol having a number of carbon or carbons of 1 to 3; and further comprising setting a weight ratio of the second solvent to the charge control agent to not less than 150 and not more than 1,000, except when a solubility of the charge control agent to the second solvent is less than 1, setting the weight ratio of the second solvent to the charge control agent to not less than 500 to not more than 1,000.

9. The method of producing the toner according to claim 8, wherein the step of forming the emulsion includes neutralizing the acid group with a base.

10. The method of producing the toner according to claim 8, further comprising adding silica after the step of washing the solid particles with the second solvent.

11. The method of producing the toner according to claim 8, wherein the charge control agent is at least one selected from the group consisting of a Nigrosine-based charge control agent, a Triphenylmethane-based charge control agent, and a quaternary ammonium salt-based charge control agent.

12. The method of producing the toner according to claim 11, wherein the alcohol is methanol.

13. The method of producing the toner according to claim 8, wherein the charge control agent is a Nigrosine-based charge control agent or a Triphenylmethane-based charge control agent; and the second solvent is methanol.

14. A method of producing a toner, the method comprising:

forming solid particles containing a charge control agent which is positively charged; and washing the solid particles having the charge control agent with a solvent in which the charge control agent is dissoluble; and further comprising washing the solid particles with an acid after the step of forming the solid particles and before the step of washing the solid particles with the solvent;

wherein the solvent is an alcohol having a number of carbon or carbons of 1 to 3; and further comprising setting a weight ratio of the second solvent to the charge control agent to not less than 150 and not more than 1,000, except when a solubility of the charge control agent to the second solvent is less than 1, setting the weight ratio of the second solvent to the charge control agent to not less than 500 to not more than 1,000.

15. The method of producing the toner according to claim 14, wherein the charge control agent is a Nigrosine-based charge control agent or a Triphenylmethane-based charge control agent; and the solvent is methanol.

16. The method of producing the toner according to claim 14, wherein the solid particles further include a resin and a colorant.

17. The method of producing the toner according to claim 16, wherein the resin is insoluble in the solvent.

* * * * *